US011180351B2

(12) United States Patent
Maini et al.

(10) Patent No.: US 11,180,351 B2
(45) Date of Patent: Nov. 23, 2021

(54) TELESCOPIC ARM FOR CRANE AND CRANE COMPRISING SAID ARM

(71) Applicant: CIFA S.P.A., Senago (IT)

(72) Inventors: Paolo Dario Maini, Lissone (IT); Giuliano Castelli, Barlassina (IT)

(73) Assignee: CIFA S.P.A., Senago (IT)

( * ) Notice: Subject to any disclaimer, the term of this patent is extended or adjusted under 35 U.S.C. 154(b) by 34 days.

(21) Appl. No.: 16/720,546

(22) Filed: Dec. 19, 2019

(65) Prior Publication Data

US 2020/0198942 A1 Jun. 25, 2020

(30) Foreign Application Priority Data

Dec. 19, 2018 (IT) ..... 102018000020221

(51) Int. Cl.
*B66C 23/70* (2006.01)

(52) U.S. Cl.
CPC ..... *B66C 23/708* (2013.01); *B66C 23/705* (2013.01)

(58) Field of Classification Search
CPC ... B66C 23/701; B66C 23/705; B66C 23/707; B66C 23/708
See application file for complete search history.

(56) References Cited

U.S. PATENT DOCUMENTS 3,749,254 A * 7/1973 Grider ..... B66C 23/708 212/348
5,628,416 A * 5/1997 Frommelt ..... B66C 23/708 212/292
6,164,468 A * 12/2000 Erdmann ..... B66C 23/708 212/292
6,206,213 B1 * 3/2001 Conrad ..... B66C 23/708 212/292
6,216,895 B1 * 4/2001 Erdmann ..... B66C 23/708 212/292
2012/0074089 A1 * 3/2012 Willim ..... B66C 23/708 212/348
2015/0041422 A1 * 2/2015 Kaupert ..... B66C 23/708 212/292

FOREIGN PATENT DOCUMENTS

DE 19525642 A1 * 1/1997 ..... B66C 23/708
DE 10004838 A1 * 9/2000 ..... B66C 23/708

OTHER PUBLICATIONS

European Patent Office, Search report EP 3670424 A1, dated Jun. 24, 2020, espacenet.com (Year: 2020).*

* cited by examiner

*Primary Examiner* — Sang K Kim
*Assistant Examiner* — Nathaniel L Adams
(74) *Attorney, Agent, or Firm* — Cantor Colburn LLP

(57) ABSTRACT

Telescopic arm for a crane for lifting loads, which comprises a first tubular segment, a second tubular segment located in the first segment and extractable with respect to the first segment along an extraction axis (X). The telescopic arm comprises a clamping device configured to axially and selectively clamp, along the extraction axis (X), the first segment and the second segment. The clamping device comprises a clamping seating provided in the first segment and a clamping pin associated with the second segment, sliding along a sliding axis (Z) transverse to the extraction axis (X) and able to be selectively inserted in the clamping seating.

11 Claims, 5 Drawing Sheets

TELESCOPIC ARM FOR CRANE AND CRANE COMPRISING SAID ARM

CROSS REFERENCE TO RELATED APPLICATION

This application is related to and claims the benefit of Italian Patent Application Number 102018000020221 filed on Dec. 19, 2018, the contents of which are herein incorporated by reference in their entirety.

FIELD OF THE INVENTION

The present invention concerns a telescopic arm for a crane and the crane comprising the telescopic arm.

BACKGROUND OF THE INVENTION

Cranes for lifting loads are known which generally comprise a truck on which a telescopic arm is mounted.

The telescopic arm comprises a plurality of segments which can be extracted telescopically, one with respect to the other, to reach a desired length.

The segments of the telescopic arm have a predominantly oblong development, a tubular conformation, and are located one inside the other and selectively extractable to assume an extended or retracted condition.

The telescopic arm is provided with a fixed end associated with the outermost segment and connected to the truck, and with a free end, associated with the innermost segment and to which a hook or other lifting mean is attached for lifting loads.

Each segment, located inside another segment, is provided with a first end located, during use, inside one of the segments, and with a second end located, during use, protruding outward.

Furthermore, each segment is provided with at least a first clamping seating made in the proximity of the first end of the segment and with a second clamping seating made in the proximity of the second end of the segment.

Each segment, located inside another segment, is also provided with at least one clamping pin axially slidable in a transverse direction with respect to the oblong development of the segment itself.

The clamping pin is normally inserted in a through seating made directly in a lateral wall of the segment. The through seating is generally made in correspondence with the first end of the segment.

The telescopic arm is also provided with a linear actuator disposed in the segment that during use is innermost, and is attached with one of its ends to the fixed end of the telescopic arm.

The actuator is also provided with an activation terminal configured to act on each clamping pin of a segment and allows to couple or uncouple the clamping pin from the clamping seating of the segment contiguous to the one considered.

For example, in a retracted condition of the telescopic arm, the clamping pin of an internal segment is inserted in the first clamping seating of the segment external to it, in order to constrain their reciprocal retracted position.

When an extension of the internal segment with respect to the external segment is required, the activation terminal decouples the clamping pin of this internal segment from the first clamping seating of the external segment.

The activation terminal also is fastened to the innermost segment, according to known modes and, with an axial movement of the linear actuator itself, determines an axial movement of the internal segment with respect to the external one, defining an extension of the telescopic arm.

When the clamping pin is positioned in correspondence with the second clamping seating of the external segment, the activation terminal axially moves the clamping pin of the internal segment to couple it with the second clamping seating of the external segment. In this way, the extended position of the internal segment is constrained with respect to the external one.

It is also known that the telescopic arms in question can have even very extended lengths, for example of about 10 m.

This longitudinal extension means that the inflection to which the telescopic arm is subjected, even only due to its own weight, at times causes problems of reciprocal alignment between the clamping seatings of the external segment and the clamping pin of the internal segment. This does not allow to clamp the retracted or extended position of two adjacent segments.

Another disadvantage of these telescopic arms is linked to the fact that, at times, the activation terminal is not able to decouple the clamping pin from the clamping seating in which it is inserted, due to the high interferences that are generated between the latter following the loads acting on the telescopic arm itself.

In order to try to address these disadvantages it is also known to increase the sizes of the reciprocal play present between the clamping pin and the clamping seating.

However, the known coupling between the clamping pin and the clamping seating in any case generates high stresses, due to contact and sliding. These stresses cause a rapid wear and/or a consequent breakage of the pin and possibly a collapse of the telescopic segment.

Moreover, this known solution makes the clamping and unclamping operations of the telescopic segments particularly difficult and noisy during the steps of clamping and unclamping the pins in the corresponding seatings.

One purpose of the present invention is to provide a telescopic arm for a crane which allows a stable and correct coupling between pin and seating, reducing the contact and sliding loads during the clamping and unclamping steps between two subsequent telescopic segments.

It is also a purpose of the present invention to provide a telescopic arm for a crane which reduces the sliding wear between pins and corresponding seatings of the telescopic segments, guaranteeing a greater overall life of the telescopic arm.

It is also a purpose of the invention to provide a telescopic arm for a crane which guarantees a high degree of precision in the attachment between the telescopic segments, both in the extracted and also in the retracted condition, with reduction of the rigid and abrupt movements during the functioning of the equipment.

Another purpose of the invention is to provide a telescopic arm for a crane which allows to reach high distances, in any case guaranteeing mechanical strength and resistance, both in the reciprocal coupling between the telescopic segments, particularly in the extracted positions, and also overall in the capacity to lift heavy loads.

The Applicant has devised, tested and embodied the present invention to overcome the shortcomings of the state of the art and to obtain these and other purposes and advantages.

SUMMARY OF THE INVENTION

The present invention is set forth and characterized in the independent claim. The dependent claims describe other characteristics of the invention or variants to the main inventive idea.

In accordance with the above purposes, a telescopic arm for a crane for lifting loads, in accordance with the present invention, comprises a first tubular segment, at least a second tubular segment located in the first segment and extractable with respect to the first segment along an extraction axis, and at least a clamping device configured to axially and selectively clamp, along the extraction axis as above, the first segment and the second segment.

In accordance with the present invention, the clamping device comprises at least one clamping seating provided in the first segment and a clamping pin associated with the second segment, sliding along a sliding axis transverse to the extraction axis and able to be selectively inserted in the clamping seating.

According to one aspect of the present invention, the clamping device comprises at least one housing seating made through through a wall of the second segment, and a bushing inserted into the housing seating and provided with a through seating into which the clamping pin is slidingly inserted.

According to another aspect of the present invention, between the housing seating and the bushing rotation limitation devices are provided, configured to allow a controlled angular rotation, around the sliding axis, of the bushing and of the clamping pin with respect to the housing seating.

The rotation limitation devices as above advantageously guarantee a high degree of precision in the attachment between the telescopic segments, both in the extracted condition and also in the retracted condition. Consequently, the operations of clamping and unclamping the reciprocal position with the pins are more fluid with less noise during the steps of clamping and unclamping between two subsequent telescopic segments.

ILLUSTRATION OF THE DRAWINGS

These and other characteristics of the present invention will become apparent from the following description of a preferred form of embodiment, given as a non-restrictive example with reference to the attached drawings wherein.

To facilitate comprehension, the same reference numbers have been used, where possible, to identify identical common elements in the drawings.

DESCRIPTION OF EMBODIMENTS

Figure 1:
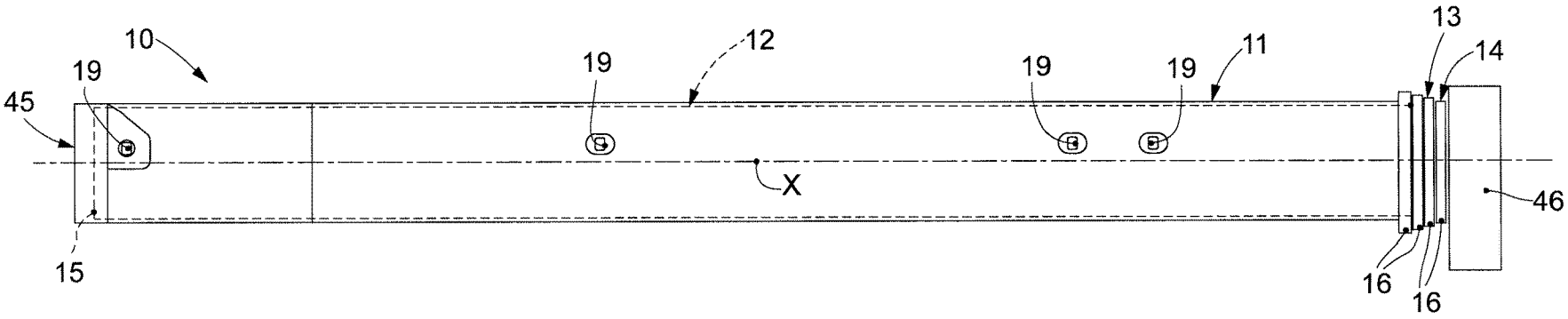
FIG. 1 is a lateral view of a telescopic arm according to the present invention, in a retracted condition.

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

With reference to the attached drawings, a telescopic arm according to the present invention is indicated with reference number 10 and can be used in a crane for lifting loads, for example, in the building and construction sector.

The telescopic arm 10 comprises a plurality of segments, in this specific case four segments and respectively a first segment 11, a second segment 12, a third segment 13 and a fourth segment 14.

It is evident that the number of segments is not limiting of the present invention, and that the telescopic arm 10 can comprise any number of segments whatsoever equal to or greater than two.

The segments 11, 12, 13 and 14 are located one inside the other and are selectively extractable along an extraction axis X to assume a retracted condition in which they are contained one inside the other and an extended condition, in which one and/or the other of the segments are at least partly protruding with respect to the other segments.

In this specific case, the fourth segment 14 is located in the third segment 13, the third segment 13 is located in the second segment 12, and the second segment 12, shown with a dashed line in FIG. 1, is installed in the first segment 11. The first segment 11 is located, during use, outside all the other segments.

In this specific case, the segments 11, 12, 13 and 14 have a tubular conformation and a predominantly oblong development along the extraction axis X.

Each segment 11-14 is provided with a first end 15 located, during use, inside one of the segments 12, 13 and 14, and with a second end 16 located protruding toward the outside with respect to the segment in which it is inserted.

The first segment 11 has its first end 15 outside the other segments and pivoted, during use, by means of connection means 45 to a fixed structure, such as the frame of a truck, not shown.

The connecting means 45 can comprise hinges, or pivots of the rotary type of the telescopic arm 10 with respect to the fixed structure as above.

A lifting mean 46 for lifting loads is associated with the second end 16 of the innermost segment, in this specific case of the fourth segment 14.

The lifting mean 46 can comprise a hook, a pulley, or suchlike.

According to some embodiments, the segments 11, 12, 13, and 14 have a box-like cross-section whose sizes are suitable to house the segments which are contained therein.

Guide elements 17 can be interposed between the segments 11, 12, 13 and 14, such as sliding blocks, provided to define a correct alignment and centering, along the extraction axis X, of one segment with respect to the other, also during movement.

At least one clamping device 18 is provided between an adjacent pair of the segments 11, 12, 13 and 14, which is configured to axially and selectively clamp, along the extraction axis X, the pair of segments.

In particular, the clamping device 18 can be configured to clamp at least one axial position, preferably at least two, even more preferably three axial positions, of two adjacent segments 11, 12, 13 and 14.

In this specific case, the clamping device 18 can be configured to define at least one retracted position, in which one segment is located completely inside another segment, and at least one extended position, in which one segment protrudes axially toward the outside with respect to the other segment that contains it. Advantageously, the clamping device 18 can define at least two extended positions, that is, one in which one segment protrudes axially and partly with respect to the other segment, and one in which one segment protrudes almost completely with respect to the other segment.

Figure 3:
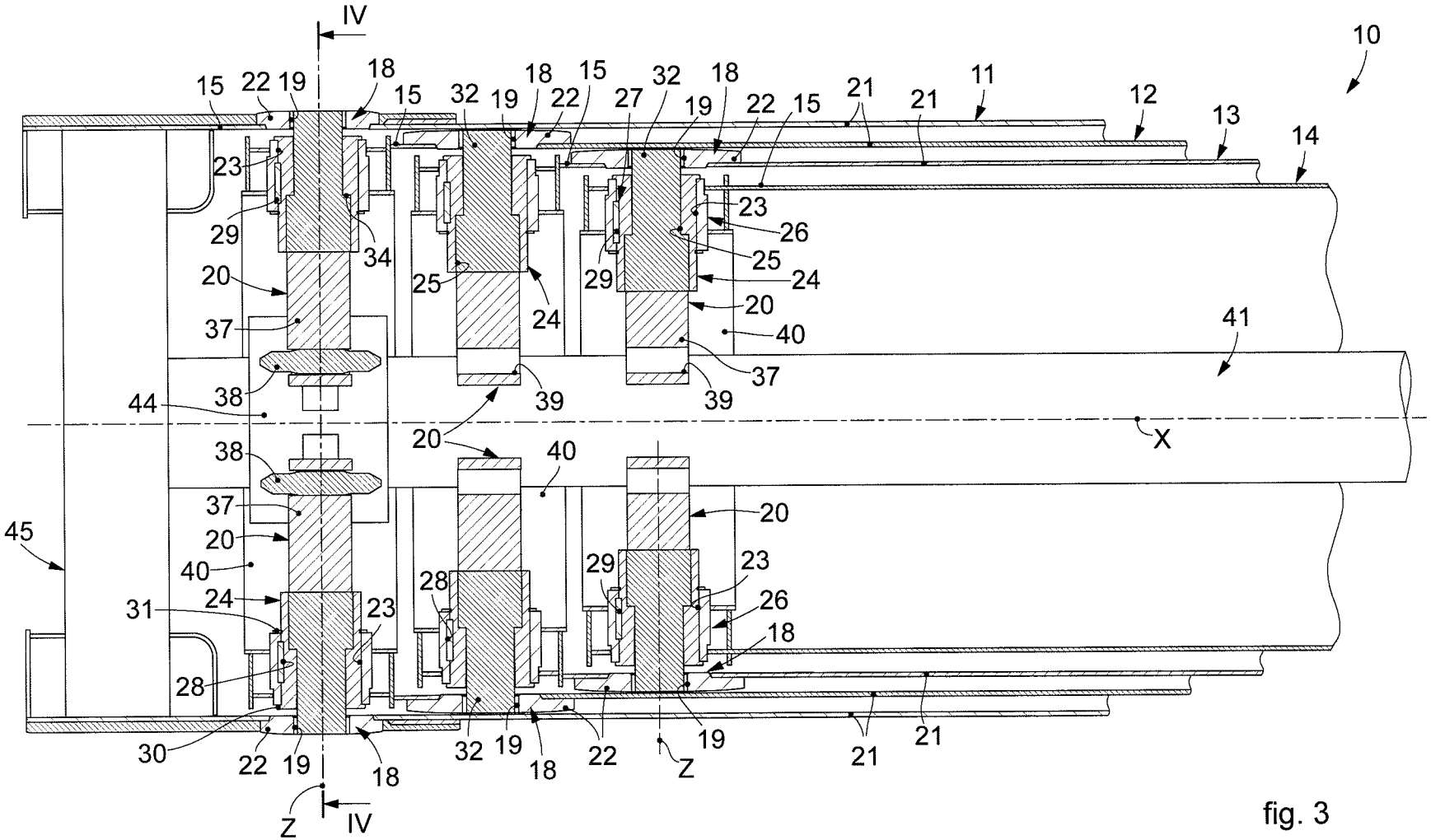
FIG. 3 is a longitudinal section view of a portion of a telescopic arm in accordance with embodiments of the invention.

According to some embodiments of the invention (FIGS. 3 and 4), each pair of segments, located adjacent, can comprise at least two clamping devices 18, disposed in opposite position with respect to the extraction axis X, and acting on opposite walls of this pair of segments defining respectively a first and a second segment.

In the following description, the application of the clamping device 18 to the first segment 11 and to the second segment 12 is described, although the teachings of the present invention can also be applied, in an analogous manner, to the other segments 13 and 14, or to a combination of two segments in which one segment is located inside another segment and is selectively mobile axially with respect to the latter.

In accordance with some embodiments of the invention, the clamping device 18 comprises at least one clamping seating 19 provided in the first segment 11, and a clamping pin 20 associated with the second segment 12, sliding along a sliding axis Z, transverse to the extraction axis X, and able to be selectively inserted in the clamping seating 19.

According to some embodiments of the invention, the clamping seating 19 is made in a lateral wall 21 of the first segment 11.

The clamping seating 19 can be made through through the lateral wall 21. However, it is not excluded that in possible variants the clamping seating 19 is made blind.

In accordance with a possible solution of the invention (FIG. 1), the first segment 11 can comprise a plurality of clamping seatings 19 distanced from each other along the extraction axis X, and each defining a respective clamping position of the second segment 12 with respect to the first segment 11.

In some embodiments, the clamping seating 19 is made in an insert 22 integrally attached to the lateral wall 21 of the first segment 11.

In accordance with one aspect of the present invention, the clamping device 18 comprises at least one housing seating 23 made through through a lateral wall 21 of the second segment 12, and a bushing 24 inserted in the housing seating 23.

The bushing 24 is provided, in turn, with a through seating 25 in which the clamping pin 20 is slidingly inserted.

In accordance with a possible solution of the present invention, the housing seating 23 is made in a tubular element 26 integrally attached to the lateral wall 21 of the second segment 12.

The housing seating 23 has a cylindrical conformation.

Similarly, the external surface of the bushing 24 has a cylindrical conformation suitable to be inserted in the housing seating 23, and to allow its rotation about an axis.

The bushing 24 can be provided with axial constraint elements 30, 31 configured to constrain the axial position of the bushing 24 itself in the housing seating 23 and allow, in any case, the circumferential rotation thereof.

The axial constraint elements can comprise an abutment collar 30 made at one end of the bushing 24 and a retaining ring 31 which can be selectively associated with the bushing 24. The retaining ring 31 can comprise an elastic ring.

The abutment collar 30 and the retaining ring 31 can be positioned, during use, in abutment against opposite ends of the tubular element 26.

In accordance with one aspect of the present invention, between the housing seating 23 and the bushing 24 there are provided rotation limitation devices 27 configured to allow a controlled angular rotation, about the sliding axis Z, of the bushing 24 and of the clamping pin 20 with respect to the housing seating 23.

According to some embodiments, the bushing 24 can be made of bronze in order to reduce the friction coefficient during this rotation, reducing the contact and sliding loads during the clamping and unclamping steps between two subsequent telescopic segments.

The particular configuration of the clamping devices 18 confers on the clamping pin 20 a further degree of freedom of movement and allows it to adapt to possible misalignments with the clamping seating 19 which is made in the first segment 11.

In the case of incorrect alignment between the clamping seating 19 and the clamping pin 20, in fact, the rotation of the latter on itself is limited to what is allowed by the rotation limitation devices 27, so that it can be introduced in the clamping seating 19.

In accordance with possible solutions, the rotation limitation devices 27 are configured to allow a rotation with respect to the sliding axis Z by an angle $\alpha$ comprised between $\pm 1°$ and $\pm 5°$.

In accordance with a possible solution of the present invention, the rotation limitation devices 27 can comprise a hollow 28 and a protruding element 29 associated with the bushing 24 and respectively with the housing seating 23, or vice versa, and wherein the protruding element 29 has smaller sizes than the hollow 28 in order to allow the controlled angular rotation as above of the bushing 24 with respect to the housing seating 23.

According to one embodiment, the hollow 28 has a width greater than that of the protruding element 29, generating a play between them.

According to some embodiments, the play can have sizes suitable to allow a rotation of the bushing 24 with respect to the housing seating 23 by the angle $\alpha$ as above.

Figure 2:
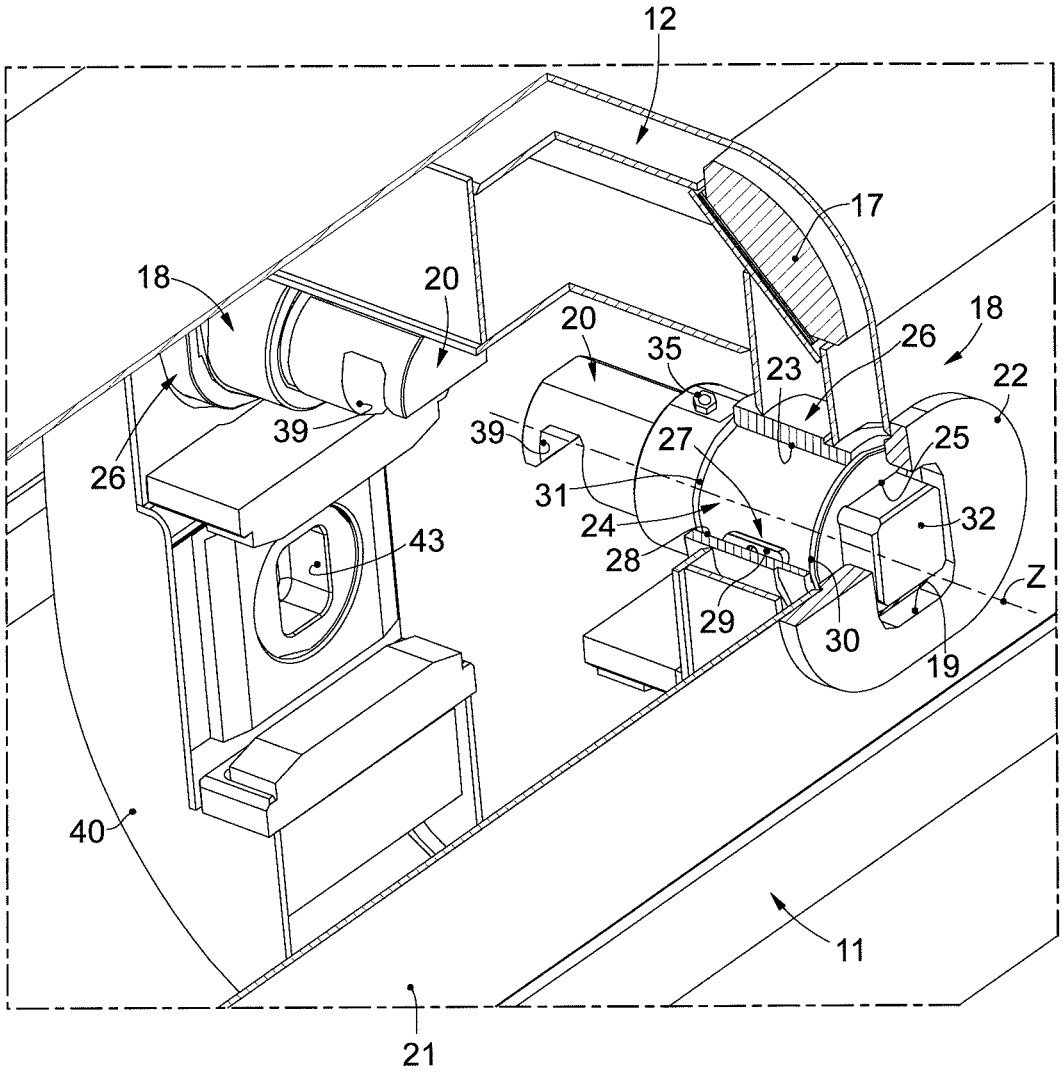
FIG. 2 is a partly sectioned perspective view of a portion of a telescopic arm according to the present invention.
Figure 5:
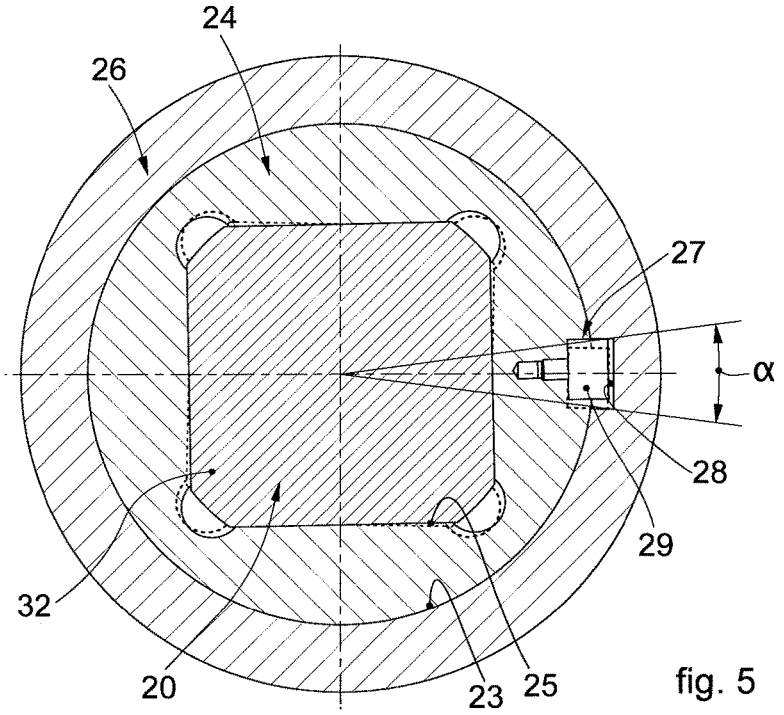
FIG. 5 is a section view, along the section line V-V of FIG. 4.

In accordance with the embodiment shown in FIGS. 2 and 5, the hollow 28 is made in the housing seating 23 while the protruding element 29 is associated with the bushing 24. This solution allows to contain the overall sizes of the clamping device 18.

The hollow 28 can have a longitudinal development that extends in a direction parallel to the sliding axis Z.

The hollow 28 can be made axially through in the surface defining the through seating 25 as above.

According to a possible solution (FIGS. 2, 5 and 6), the protruding element 29 can comprise a tongue attached on the external surface of the bushing 24.

Figure 6:
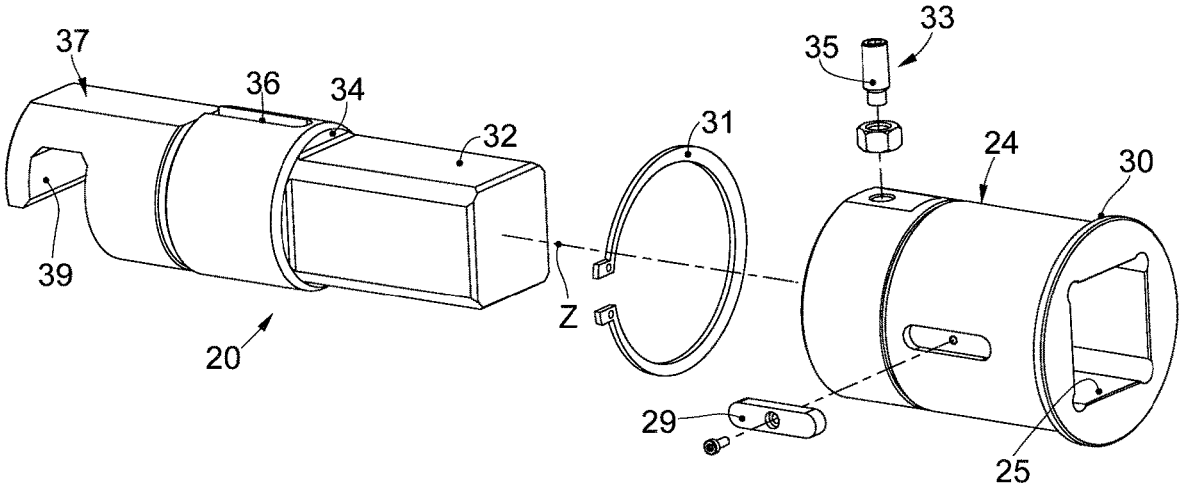
FIG. 6 is an exploded perspective view of parts of the telescopic arm according to the present invention.

The protruding element 29 can be attached to the bushing 24, for example in a seating made in the latter as shown in FIG. 6.

According to a possible solution, the hollow 28 and the protruding element 29 can develop in a direction substantially parallel to the sliding axis Z as above.

In accordance with another solution, the clamping pin 20 is configured to slide only axially, along the sliding axis Z, in the through seating 25 of the bushing 24, and to prevent a reciprocal rotation of the clamping pin 20 with respect to the through seating 25.

In a first variant, between the clamping pin 20 and the through seating 25 of the bushing 24 there is defined a geometric coupling of a shape suitable to allow axial sliding and prevent a reciprocal rotation.

For example, it can be provided that at least one portion of the clamping pin 20 has a polygonal cross-section, in this specific case square, and that the through seating 25 has a mating conformation.

According to variant embodiments of the invention, however, it is not excluded that between the clamping pin 20 and the through seating 25 of the bushing 24 there are interposed mechanical elements, such as grooved seatings and tongues, suitable to allow an axial sliding of the clamping pin 20 with respect to the through seating 25, and to prevent a reciprocal rotation thereof.

In accordance with some solutions, the clamping pin 20 is provided with a coupling portion 32 which can be selectively coupled to the through seating 25 and insertable, during use, into the clamping seating 19 provided in the first segment 11.

The cross-section of the coupling portion 32 can have a polygonal shape, in this specific case square, possibly with rounded or beveled edges. In the same manner, it can be provided that the clamping seating 19 provided in the first segment 11 also has a shape mating with that of the clamping seating 19.

A mechanical play can be provided between the clamping seating 19 and the coupling portion 32 which, by way of example only, can have sizes comprised between 0.5 mm and 4 mm, preferably between 1 mm and 3 mm.

Between the clamping pin 20 and the through seating 25 there can be interposed travel limitation elements 33 provided to limit the axial travel of the clamping pin 20 in the through seating 25 of the bushing 24.

The travel limitation elements 33 can allow an axial sliding of the clamping pin 20 suitable to make the latter assume at least a first axial position in which the clamping pin 20 is inserted in the clamping seating 19 of the first segment 11, and a second axial position in which the clamping pin 20 is disengaged from the clamping seating 19.

In accordance with possible solutions, the travel limitation elements 33 can comprise abutment walls 34 made in the through seating 25 of the bushing 24 and in the clamping pin 20.

Moreover, the travel limitation elements 33 can comprise an abutment pin 35 associated with the bushing 24 and located, during use, protruding toward the inside of the through seating 25. These travel limitation elements 33 can also comprise an abutment seating 36 made in the clamping pin 20 and in which the abutment pin 35 is positioned, during use.

The clamping pin 20 is also provided with an attachment portion 37, located protruding from the bushing 24 and on which an actuation terminal 38 can act, according to the modes described below, in order to determine the axial translation along the sliding axis Z of the clamping pin 20 in the through seating 25.

Figure 4:
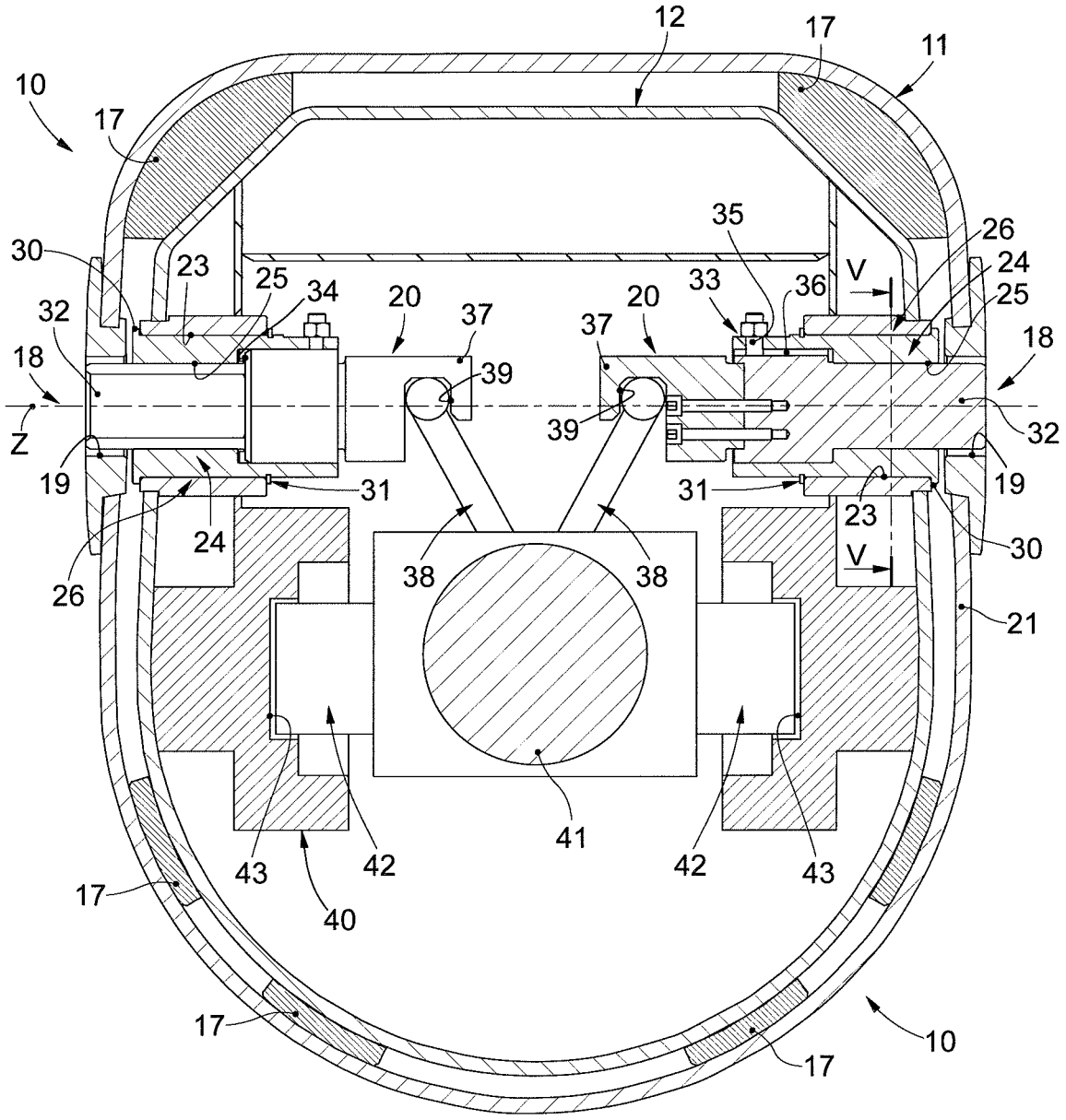
FIG. 4 is a cross-section view, along the section line IV-IV of FIG. 3.

The attachment portion 37 and the coupling portion 32 can be defined by two separate components, reciprocally coupled to each other, for example by means of threaded elements (FIG. 4).

The attachment portion 37 can comprise a concavity 39 in which the actuation terminal 38 can act.

According to one solution of the present invention, a respective clamping device 18 is associated with each of the segments 11-14 of the telescopic arm 10, and the clamping devices 18, or at least some of them, have their attachment portions 37, in this specific case the concavities 39, aligned along a common axis parallel to the extraction axis X as above.

In this way, the actuation terminal 38 can be moved axially along the extraction axis X and determine the actuation of one or the other of the clamping devices 18.

In accordance with this solution of the invention, all the concavities 39 of the attachment portions 37 can have the same sizes and be facing the same direction, to allow the actuation terminal 38 to act on each of them.

In accordance with possible solutions, the housing seating 23, or the tubular element 26 which defines it, can be installed in correspondence with the first end 15 of the segment, that is, the end which is always located inside the telescopic arm 10.

The first end 15 can comprise a support head 40 to which the lateral walls 21 defining the segment are connected.

The housing seating 23 can be made in the support head 40, or the tubular element 26 can be connected thereto.

According to possible solutions, the telescopic arm 10 can comprise an actuator 41 installed in the tubular cavity of the segment located most internally during use, in this specific case in the fourth segment 14, and connected, for example with one of its ends, to the segment located most externally during use, in this specific case the first segment 11.

The actuator 41 can comprise a hydraulic cylinder.

The actuator 41 can have a length substantially equal to or smaller than the length of the segment located most internally during use, in this specific case with respect to the length of the first segment 11.

The actuation terminal 38 is associated with the actuator 41 and is axially moved along the extraction axis X in order to be disposed, on each occasion, in cooperation with one or the other of the clamping pins 20.

In accordance with a possible solution, the actuator 41 can also be provided with at least one, in this specific case two, selective attachment elements 42 selectively movable in a direction transverse to the extraction axis X.

Each segment 12-14, axially mobile along the extraction axis X, is also provided with at least one attachment seating 43 in which the selective attachment element 42 of the actuator 41 is able to be selectively inserted.

According to possible solutions, each segment 12-14 can comprise two pairs of attachment seatings 43 made on opposite walls of the segments, for example in the respective support heads 40.

The selective attachment elements 42 and the actuation terminals 38 can be installed on a single support body 44 which is moved by means of the actuator 41 as above.

The modes for driving the actuator 41 and for extracting the second segment 12 with respect to the first segment 11 are described below.

In the retracted condition, in which the second segment 12 is completely inside the first segment 11, the clamping pin 20 of the second segment 12 is inserted in a first clamping seating 19 in the proximity of the first end 15 of the first segment 11.

When an extension of the second segment 12 with respect to the first segment 11 is required, the actuation terminal 38 is brought, with the actuator 41, in correspondence with the clamping pin 20 to be decoupled. The actuation terminal 38 is inserted into the concavity 39 of the attachment portion 37 and, by means of translation along the sliding axis Z, decouples the clamping pin 20 from the first clamping seating 19.

The selective attachment element 42 is driven in order to be inserted in the attachment seating 43 of the second segment 12 so that when the linear actuator 41 moves the actuation terminal 38 along the extraction axis X, the second segment 12 is extracted with respect to the first segment 11 in order to reach a desired extended condition.

This desired extended condition corresponds to a condition in which the clamping pin 20 of the second segment 12 is aligned with a second clamping seating 19. The second clamping seating 19 can be chosen from one of the clamping seatings 19 present in the lateral wall 21, along the oblong development of the first segment 11, according to the length of the telescopic arm 10 to be reached.

In the extended condition, the actuation terminal 38 acts on the attachment portion 37 and moves the clamping pin 20 along the sliding axis Z. The latter is inserted in the second clamping seating 19 constraining the reciprocal position of the second segment 12 in extended condition with respect to the first segment 11.

Advantageously, in case of problems of reciprocal alignment between the second clamping seating 19 and the clamping pin 20, the rotation limitation devices 27 allow a limited rotation of the bushing 24 and, therefore, of the clamping pin 20 to facilitate their insertion in the clamping seating 19. In this way, the clamping pin 20 aligns with the new clamping seating 19 guaranteeing a correct coupling of the second segment 12 with respect to the first segment 11 both in the extended and also in the retracted condition.

It is clear that modifications and/or additions of parts may be made to the telescopic arm 10 as described heretofore, without departing from the field and scope of the present invention.

It is also clear that, although the present invention has been described with reference to some specific examples, a person of skill in the art shall certainly be able to achieve many other equivalent forms of telescopic arm 10, having the characteristics as set forth in the claims and hence all coming within the field of protection defined thereby.

The invention claimed is:

1. A telescopic arm for a crane for lifting loads, comprising a first tubular segment, at least a second tubular segment located in the first tubular segment and extractable with respect to the first tubular segment along an extraction axis, and at least a clamping device configured to axially and selectively clamp, along said extraction axis, the first tubular segment and the second tubular segment, wherein said clamping device comprises at least one clamping seating provided in said first tubular segment and a clamping pin associated with the second tubular segment, sliding along a sliding axis transverse to said extraction axis and able to be selectively inserted in said clamping seating, wherein said clamping device further comprises at least one housing seating made through a lateral wall of said second tubular segment, and a bushing inserted into said at least one housing seating and provided with a through seating into which said clamping pin is slidingly inserted, and wherein between the at least one housing seating and the bushing, rotation limitation devices are provided configured to allow a controlled angular rotation around the sliding axis of said bushing and of said clamping pin with respect to said at least one housing seating.

2. The arm as in claim 1, wherein said rotation limitation devices are configured to allow a controlled rotation with respect to the sliding axis by an angle comprised between ±1° and ±5°.

3. The arm as in claim 1, wherein said rotation limitation devices comprise a hollow and a protruding element associated with said bushing and respectively with said at least one housing seating, or vice versa, and wherein said protruding element has sizes smaller than said hollow to allow said controlled angular rotation of the bushing with respect to the at least one housing seating.

4. The arm as in claim 3, wherein said protruding element comprises a tongue attached on the external surface of said bushing.

5. The arm as in claim 1, wherein said clamping pin is configured to slide only axially along the sliding axis in the through seating of the bushing, and to prevent a reciprocal rotation of the clamping pin with respect to the through seating.

6. The arm as in claim 1, wherein said bushing is provided with axial constraint elements configured to constrain the axial position of the bushing itself in the at least one housing seating, and to allow the circumferential rotation thereof.

7. The arm as in claim 1, wherein said clamping pin is provided with an attachment portion, located protruding from the bushing and on which an actuation terminal acts to determine the axial translation along the sliding axis of the clamping pin in the through seating so that it can be selectively inserted into said clamping seating.

8. The arm as in claim 1, wherein said first tubular segment comprises a plurality of clamping seatings distanced from each other along said extraction axis, and each defining a respective clamping position of said second tubular segment with respect to said first tubular segment.

9. The arm as in claim 1, wherein said arm comprises a plurality of segments located one inside the other and selectively extractable along the extraction axis, and wherein each pair of segments comprises two clamping devices located in an opposite position with respect to the extraction axis, and acting on opposite walls of said pair of segments.

10. A crane comprising the telescopic arm of claim 1, provided with a plurality of segments.

11. The arm as in claim 1, wherein the rotation limitation devices comprise a hollow and a protruding element associated with the bushing and with the at least one housing seating.

* * * * *